US009295301B2

(12) United States Patent
Rastello

(10) Patent No.: US 9,295,301 B2
(45) Date of Patent: Mar. 29, 2016

(54) SKI BOOT SYSTEM

(76) Inventor: Kelly Rastello, Fort Collins, CO (US)

( * ) Notice: Subject to any disclaimer, the term of this patent is extended or adjusted under 35 U.S.C. 154(b) by 710 days.

(21) Appl. No.: 13/298,188

(22) Filed: Nov. 16, 2011

(65) Prior Publication Data

US 2013/0118040 A1 May 16, 2013

(51) Int. Cl.

| | |
|---|---|
| ***A43B 5/04*** | (2006.01) |
| ***A43B 5/16*** | (2006.01) |
| ***A43B 3/06*** | (2006.01) |
| ***A43B 23/02*** | (2006.01) |

(52) U.S. Cl.

CPC ..... *A43B 5/0405* (2013.01); *A43B 3/06* (2013.01); *A43B 5/0427* (2013.01); *A43B 5/0476* (2013.01); *A43B 23/0295* (2013.01)

(58) Field of Classification Search

CPC ..... A43B 5/04; A43B 5/0405; A43B 5/0409; A43B 5/0435; A43B 5/0439; A43B 5/0472; A43B 5/0476

USPC ..... 36/115, 117.1, 117.2, 117.6, 117.7, 36/117.8, 118.1, 118.2, 118.7

See application file for complete search history.

(56) References Cited

U.S. PATENT DOCUMENTS

| | | | | | |
|---|---|---|---|---|---|
| 3,405,463 | A | * | 10/1968 | Werner | A43B 5/0454 36/117.6 |
| 3,530,596 | A | * | 9/1970 | Misteli | A43B 5/04 36/117.6 |
| 3,593,435 | A | * | 7/1971 | Lange | A43B 23/16 36/117.6 |
| 3,718,994 | A | | 3/1973 | Spier | |
| 3,849,914 | A | * | 11/1974 | Bertele | A43B 5/0415 36/117.4 |
| 4,068,337 | A | | 1/1978 | Hanson et al. | |
| 4,255,202 | A | | 3/1981 | Swan, Jr. | |
| 4,317,296 | A | | 3/1982 | Hanson | |
| 4,599,811 | A | | 7/1986 | Rousseau | |
| 4,802,290 | A | * | 2/1989 | Marega | A43B 5/0447 24/69 SK |
| 4,949,479 | A | * | 8/1990 | Ottieri | A43B 5/0435 36/117.1 |
| 4,998,358 | A | | 3/1991 | Girardelli | |
| 5,067,257 | A | * | 11/1991 | Coomer | A43B 5/0405 36/117.6 |
| 5,174,050 | A | * | 12/1992 | Gabrielli | A43B 23/26 36/10 |
| 5,199,726 | A | * | 4/1993 | Willett | A43B 5/1641 280/11.27 |
| 5,595,006 | A | | 1/1997 | Perrissoud et al. | |

(Continued)

FOREIGN PATENT DOCUMENTS

| | | | |
|---|---|---|---|
| DE | 1923818 | A1 | 11/1970 |
| DE | 7022047 | U | 2/1971 |

(Continued)

*Primary Examiner* — Robert J Hicks
*Assistant Examiner* — Cameron A Carter
(74) *Attorney, Agent, or Firm* — James A. Sheridan; Sheridan Law, LLC

(57) ABSTRACT

There is disclosed a ski boot system. In an embodiment, an outer shell has right and left side portions formed by a longitudinal split. A hinged connection is provided between the portions. The open configuration allows placement of an inner liner into the shell. The closed configuration restricts removal of the liner from the shell. A selectively fastenable connector extends between the right and left side portions. The selectively fastenable connector permits selective positioning of the shell between open and closed configurations. The liner of a ski boot includes a wall of material defining inner and outer surfaces. The outer surface defines an exterior having dimensions sized to compressively fit within the shell. The inner surface defines an interior having dimensions sized to receive a foot. A shape memory foam forms at least a portion of the wall of material and is configured to conform to the foot.

3 Claims, 17 Drawing Sheets

(56) References Cited

U.S. PATENT DOCUMENTS

| | | | | |
|---|---|---|---|---|
| 5,673,448 | A * | 10/1997 | Lang | A43B 5/0405 12/142 P |
| 5,893,222 | A * | 4/1999 | Donnelly | A43B 5/0405 36/10 |
| 6,226,898 | B1 * | 5/2001 | Trimble | A43B 3/0047 36/10 |
| 6,729,048 | B1 | 5/2004 | Grandin et al. | |
| 7,386,947 | B2 * | 6/2008 | Martin | A43B 5/0401 36/10 |
| 7,736,208 | B2 * | 6/2010 | Bonis | A63B 31/11 441/64 |
| 2002/0088146 | A1 | 7/2002 | Joseph et al. | |
| 2003/0097766 | A1 | 5/2003 | Morgan | |
| 2003/0115777 | A1 * | 6/2003 | Hall | A43B 3/0031 36/117.6 |
| 2004/0049950 | A1 | 3/2004 | Van Horne | |
| 2004/0074110 | A1 * | 4/2004 | Borsoi | A43B 5/0405 36/50.5 |
| 2004/0148807 | A1 | 8/2004 | Grandin | |
| 2004/0200098 | A1 * | 10/2004 | Martin | A43B 3/0047 36/114 |
| 2004/0244221 | A1 * | 12/2004 | Hall | A43B 5/0405 36/10 |
| 2006/0064904 | A1 | 3/2006 | Confortin et al. | |
| 2006/0162192 | A1 * | 7/2006 | Roux | A43B 1/0072 36/118.2 |
| 2007/0294920 | A1 | 12/2007 | Baychar | |
| 2008/0047165 | A1 * | 2/2008 | Keen | A43B 3/22 36/50.1 |
| 2009/0255149 | A1 * | 10/2009 | Rigat | A43B 1/0018 36/117.3 |
| 2009/0277046 | A1 * | 11/2009 | Sartor | A43C 11/142 36/118.7 |
| 2010/0180471 | A1 * | 7/2010 | Dodge | A43B 5/04 36/117.3 |
| 2010/0229425 | A1 * | 9/2010 | Parisotto | A43B 5/04 36/117.1 |
| 2011/0099846 | A1 * | 5/2011 | Fischer | A43B 5/0433 36/117.1 |

FOREIGN PATENT DOCUMENTS

| | | | |
|---|---|---|---|
| DE | 2709134 | A1 | 9/1977 |
| EP | 0824943 | A1 | 2/1998 |
| EP | 1295540 | B1 | 3/2003 |
| EP | 1527706 | B1 | 5/2005 |
| FR | 1561350 | A | 3/1969 |
| GB | 2474289 | A | 4/2011 |
| WO | 96/23429 | A1 | 8/1996 |
| WO | 96/24266 | A1 | 8/1996 |
| WO | 97/26947 | A1 | 7/1997 |
| WO | 00/51458 | A1 | 9/2000 |
| WO | 2006/077606 | A1 | 7/2006 |
| WO | 2009/097550 | A1 | 8/2009 |

* cited by examiner

SKI BOOT SYSTEM

BACKGROUND

The basic function of a ski boot is to transmit a skier's movements to the skis. Previously, skiers wore everyday winter footwear, and though warm and comfortable, this everyday winter footwear provided little ankle support and gave the skier absolutely no control over the skis. Thick, heavy leather boots supplanted these boots. Steel shanks were installed in the leather sole to counteract buckling effects. Added rigidity was provided with long straps of leather. Porous rubber boot inserts were designed to support the ankle while providing a more conformable fit. Buckle boots implemented with these boots deformed the leather. Plastic ski boots were introduced with forward flex, lateral rigidity, and a height to permit the lower leg to help control skiing.

Custom foaming is a process in which a skier's foot is sealed into an inner boot through an injection of polyurethane foam. While custom foaming was popular with skiers, it was a constant nightmare for ski shop technicians who found the process messy, complicated and costly since any boot foamed improperly had to be thrown away. Two years after its introduction, the process was abandoned in favor of more economical inserts.

The inner boot is the lining underneath the shell. The lining is made of a pliable, cushioning material that provides insulation and added fit. This material can be a gel or synthetic that molds itself to the foot over extended use or it can be a material that, when heated, provides an instantaneous custom fit.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an embodiment, there is disclosed an outer shell of a ski boot, the outer shell comprising a right side portion and a left side portion formed by a longitudinal split through the outer shell of the ski boot; a hinged connection between the right side portion and the left side portion, the hinged connection permitting selective positioning of the outer shell between an open configuration and a closed configuration, the open configuration allowing placement of an inner liner into the interior of the shell, and the closed configuration restricting removal of the liner from the interior of the shell; and a selectively fastenable connector extending between the right side portion and the left side portion, the selectively fastenable connector permitting selective positioning of the outer shell between the open configuration and the closed configuration with only a hand of a user and without an additional tool.

In another embodiment, there is provided an inner liner of a ski boot, the inner liner comprising a wall of material defining an inner surface and an outer surface, the outer surface defining an exterior having dimensions sized to compressively fit within an outer shell of the ski boot, and the inner surface defining an interior having dimensions sized to receive a foot of a skier; an a shape memory foam forming at least a portion of the wall of material, the shape memory foam configured to conform to the shape of the foot of the skier.

In still another embodiment, there is provided a ski boot system, the ski boot system comprising ski boot system, the ski boot system comprising an outer shell and an inner shell of the ski boot, the outer shell comprising a right side portion and a left side portion formed by a longitudinal split through the outer shell of the ski boot; a hinged connection between the right side portion and the left side portion, the hinged connection permitting selective positioning of the outer shell between an open configuration and a closed configuration, the open configuration allowing placement of the inner liner into the interior of the shell, and the closed configuration restricting removal of the liner from the interior of the shell; and a selectively fastenable connector extending between the right side portion and the left side portion, the selectively fastenable connector permitting selective positioning of the outer shell between the open configuration and the closed configuration with only a hand of a user and without an additional tool; and the inner liner comprising a wall of material defining an inner surface and an outer surface, the outer surface defining an exterior having dimensions sized to compressively fit within the outer shell of the ski boot, and the inner surface defining an interior having dimensions sized to receive a foot of a skier; and a shape memory foam forming at least a portion of the wall of material, the shape memory foam configured to conform to the shape of the foot of the skier.

Additional objects, advantages and novel features of the technology will be set forth in part in the description which follows, and in part will become more apparent to those skilled in the art upon examination of the following, or may be learned from practice of the technology.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

DETAILED DESCRIPTION

Embodiments are described more fully below in sufficient detail to enable those skilled in the art to practice the system and method. However, embodiments may be implemented in many different forms and should not be construed as being limited to the embodiments set forth herein. The following detailed description is, therefore, not to be taken in a limiting sense.

Figure 1:
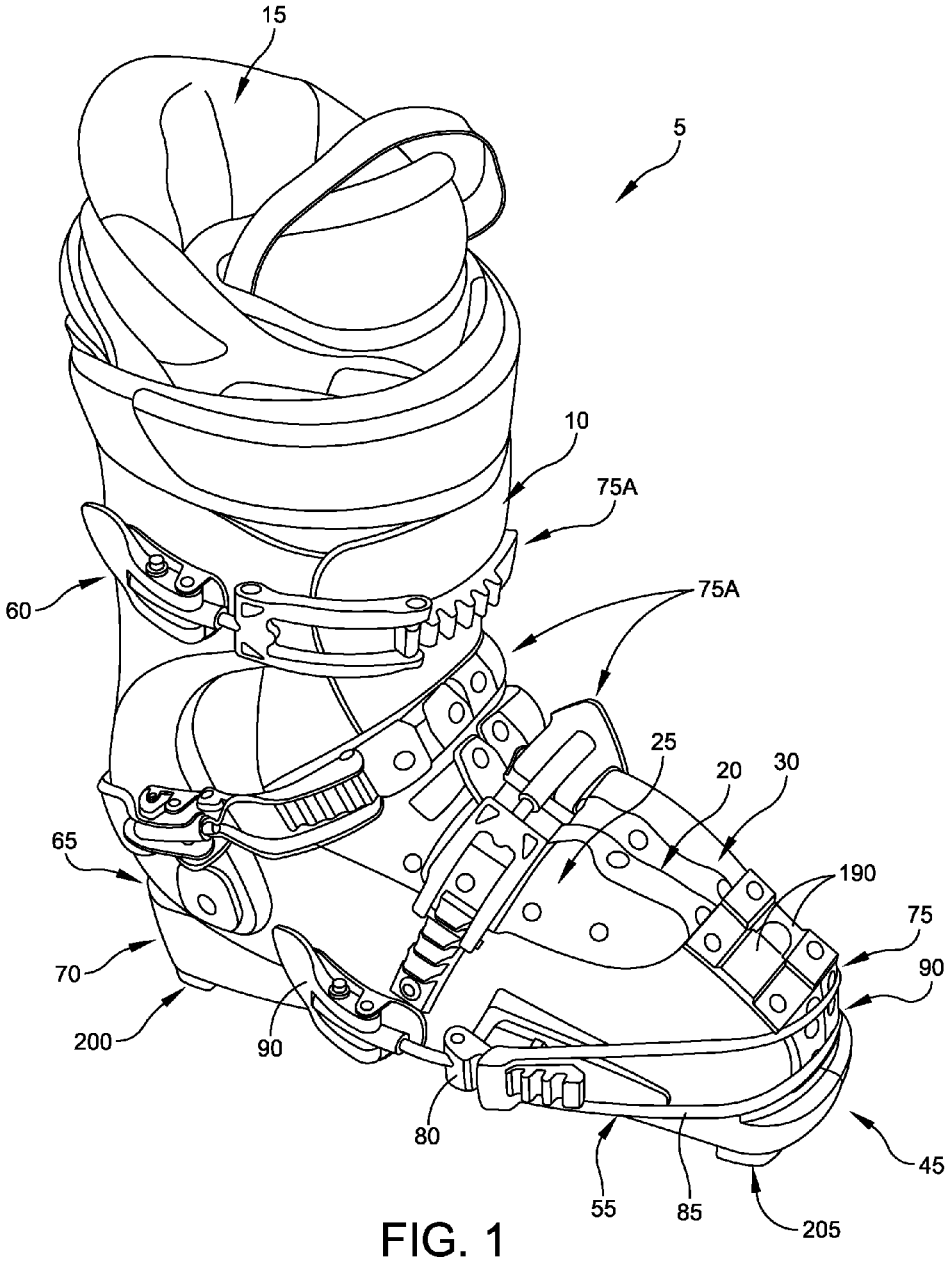
FIG. 1 illustrates a perspective view of an exemplary embodiment of a ski boot having a longitudinally split outer shell and a memory foam inner liner.
Figure 2:
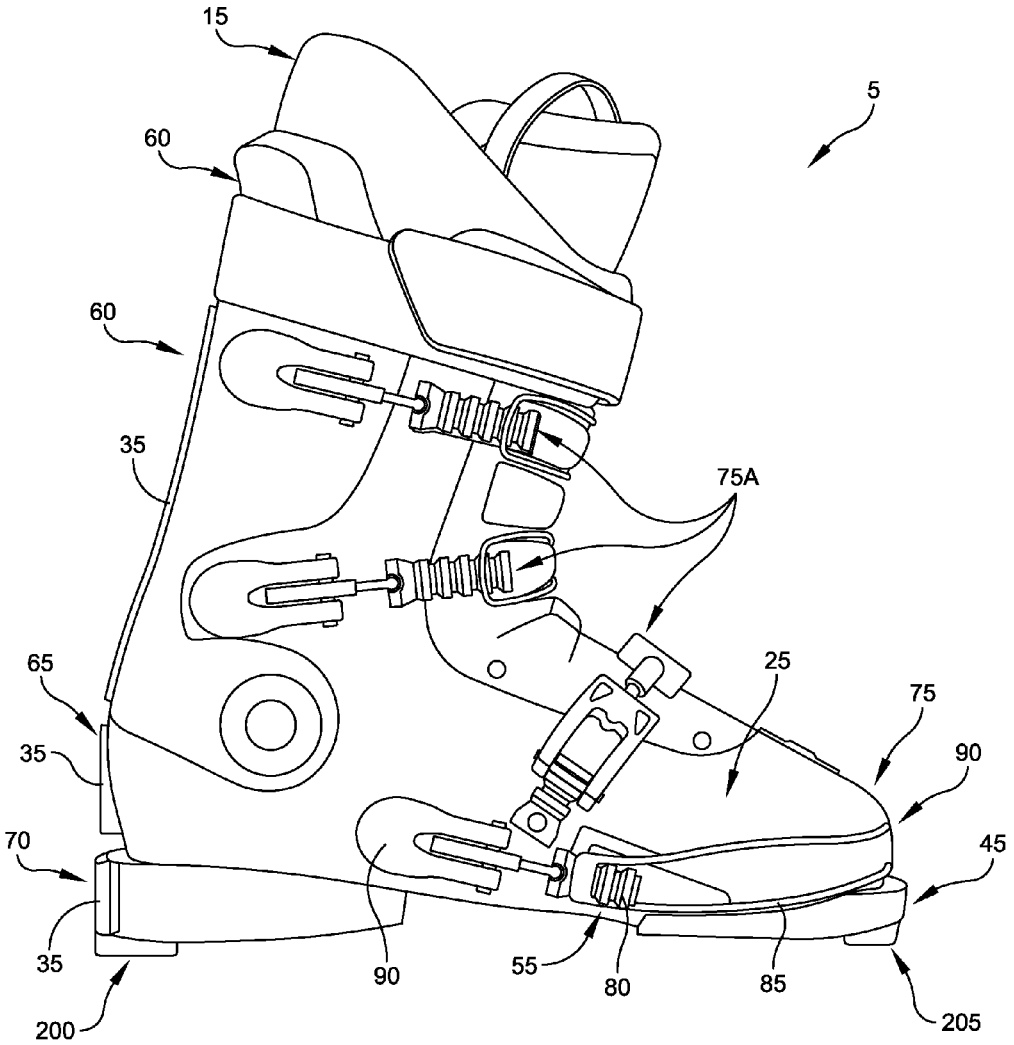
FIG. 2 is a right side elevational view of the ski boot of FIG. 1.

Broadly, and with reference to FIGS. 1 and 2, an embodiment of the present invention provides a ski boot system 5. In an embodiment, there is provided an outer shell 10 and an inner liner 15. A longitudinal split 20 through the outer shell 10 may form a right side portion 25 and a left side portion 30.

Figure 3:
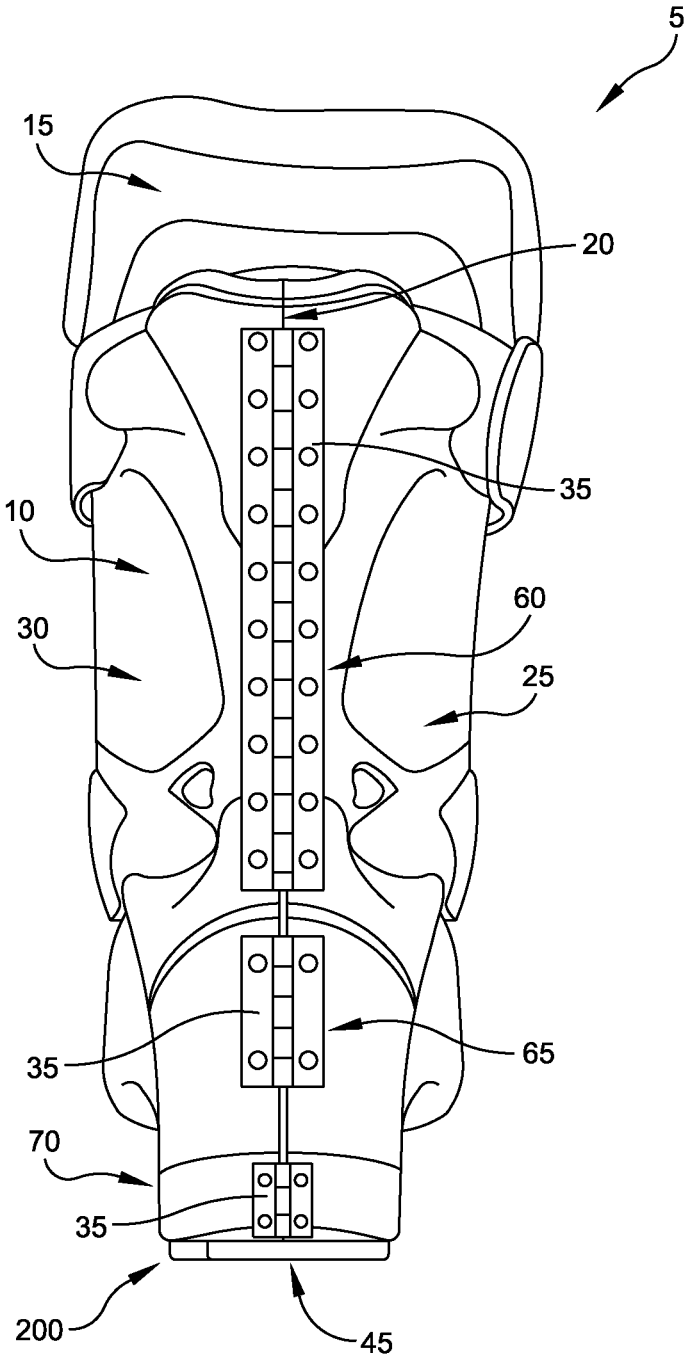
FIG. 3 is a rear elevational view of the ski boot of FIG. 1.

With reference to FIG. 3, a hinged connection 35 may be between the right side portion 25 and the left side portion 30. The hinged connection 35 may permit selective positioning of the outer shell 10 between an open configuration 40 (FIG. 4) and a closed configuration 45 (FIG. 1.) The open configuration 40 (FIG. 4) allows placement of the inner liner 15 into the interior 50 of the shell 10. The closed configuration 45 restricts removal of the liner 15 from the interior 50 of the shell 10. Typically made of plastic or composite, the outer shell 10 provides stability to the boot and is primarily responsible for the transfer of energy from the body to the ski. The rigidity of the boot also provides foot and ankle protection.

With reference to FIG. 1, a selectively fastenable connector 55 may extend between the right side portion 25 and the left side portion 30. The selectively fastenable connector 55 may permit selective positioning of the outer shell 10 between the open configuration 40 and the closed configuration 45 with only a hand of a user and without an additional tool. In other words, outer shell 10 may be opened or closed by a skier, boot fitter, or other person without extensive joining or removal of hardware, the use of saws, glues, adhesives, bolts, or other time consuming and potentially damaging mechanical reconfiguration of the ski boot system. The longitudinally split sections of the boot, together with the selectively fastenable connector, or other skier operable closures, allow for ease of entry, enhanced comfort, and optimized boot fit.

Figure 4:
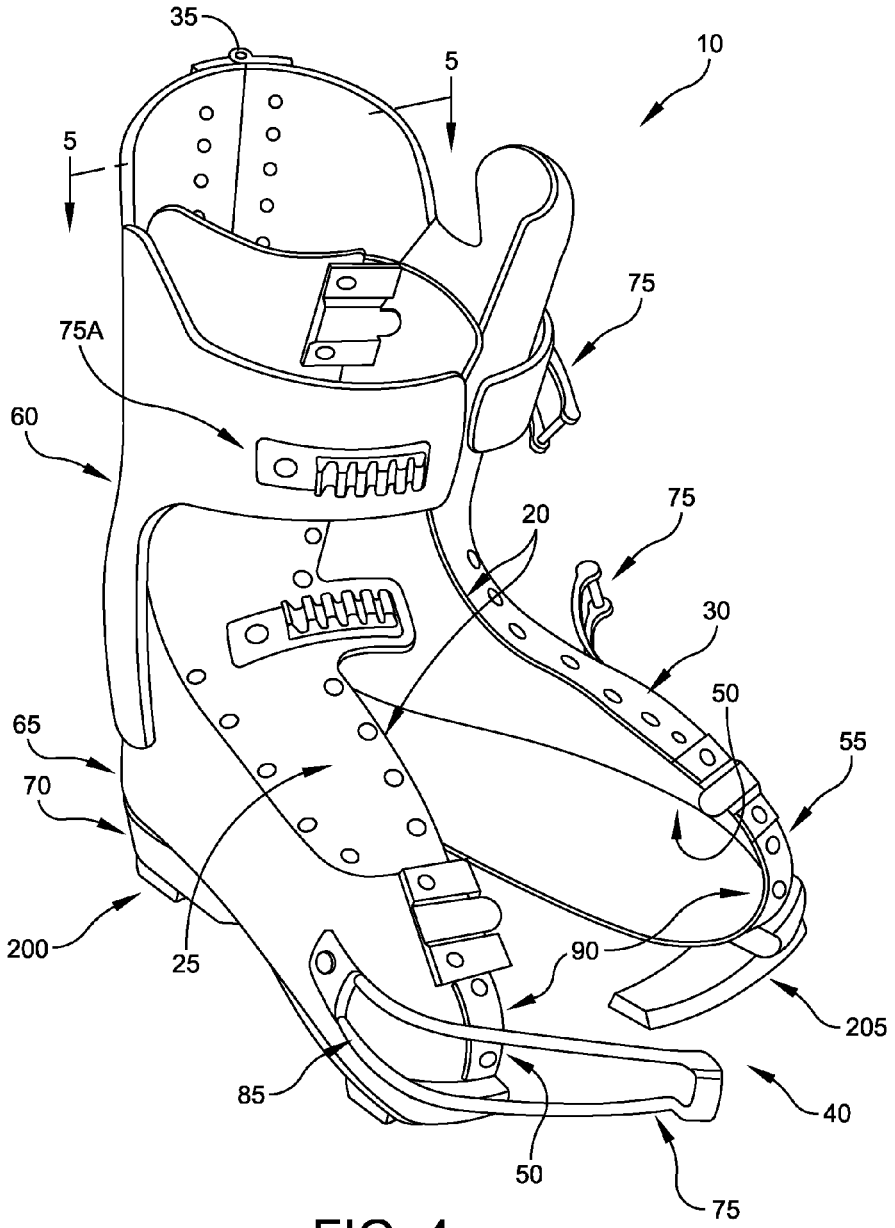
FIG. 4 is a perspective view of the outer shell in an open position illustrating the ski boot shell of FIG. 1.

In one embodiment, and with reference to FIG. 4, the hinged connection 35 may include multiple separate sections. Components of the separate sections may be disposed at a rear portion of the longitudinally split shell 10. In an embodiment, the hinged connection 35 may be split into several sections and disposed on an upper cuff 60, a lower cuff 65, and a heel 70. The upper cuff of a ski boot is the portion that wraps around the calf, upper ankle and shin. It is typically connected to the lower boot by a hinge (distinct from the hinged connection 35) and is responsible for the overall stiffness, lateral stability and forward lean of the boot.

With reference to FIG. 1, the selectively fastenable connector 55 may be disposed at a front (or toe) portion of the longitudinally split shell 10. In an embodiment, the selectively fastenable connector 55 is a buckle system 75 having a ladder 80, bail 85, and latch arm 90. A recessed portion 95 may be provided at the front (or toe) portion and the recessed portion 95 may be configured to receive the bail 85 of the selectively fastenable connector 55. This recessed portion 95 may include notched out sections of the shell 10 in order to hold the cable or bail 85 of the connector 55 just above the front lug of the shell 10. This lug is the portion that clicks into a ski binding. Blending the cable into the shell prevents any adverse effects on the operation of the boot and binding interface. However, there is usually a gap between the boot and the binding so as to allow the cable or bail 85 to remain slightly exposed from the surface of shell 10.

Buckle system 75 may be in addition to or supplemented by other buckles 75A that latch to close the shell 10. In addition to the buckles identified herein, many styles of buckles or fasteners may be used to close various portions of the shell 10. In an embodiment, the buckle system may include the ladder 80, the bail 85, and the latch arm 90 (which may be referred to as the buckle itself.) The ladder 80 is the graduated rung that the bail 85, or wire, hooks onto so that the buckle latch arm 90 can close so as to latch the boot tightly around the foot or ankle. Ski boots may have as many as four buckles, each drawing the boot tightly around a different segment of the foot or ankle.

Figure 5:
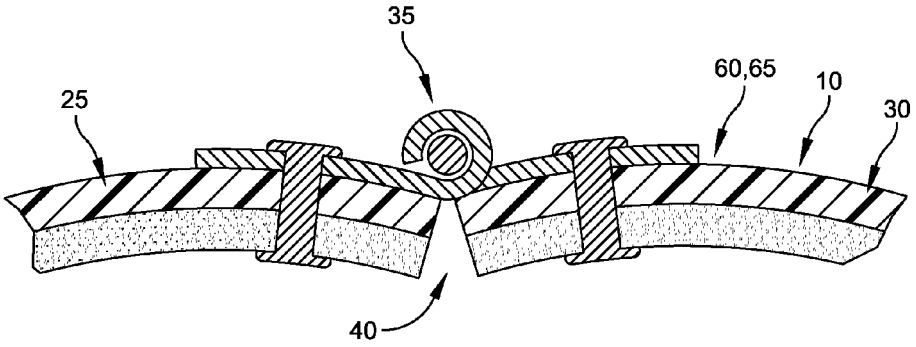
FIGS. 5 and 6 illustrate a cross-sectional view of an embodiment of the hinge of FIG. 3.
Figure 6:
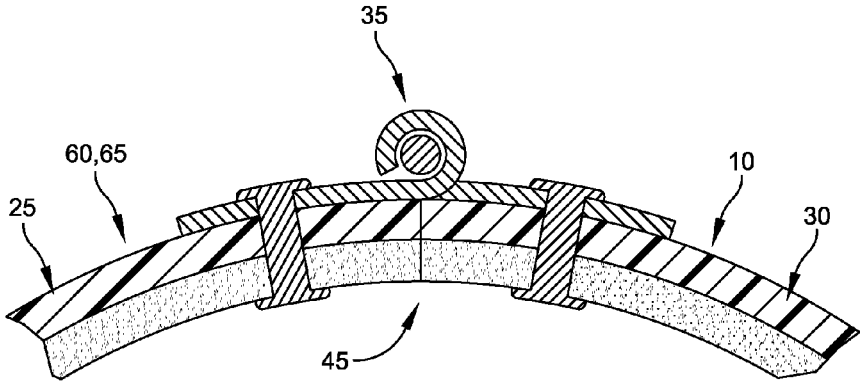

FIGS. 5 and 6 are cross-sectional illustrations of embodiments of the hinged connection 35 between the right side portion and the left side portion. In FIG. 5, the hinged connection 35 is shown in the open configuration 40. In FIG. 6, the hinged connection 35 is shown in the closed configuration 45. In one embodiment, hinged connection may be disposed protruding away from the outer shell 10 at the upper cuff 60 and the lower cuff 65. In various embodiment, the hinged connection 35 may be configured to maintain the right side portion 25 and the left side portion 30 in pivotal attachment with one another.

Figure 5A:
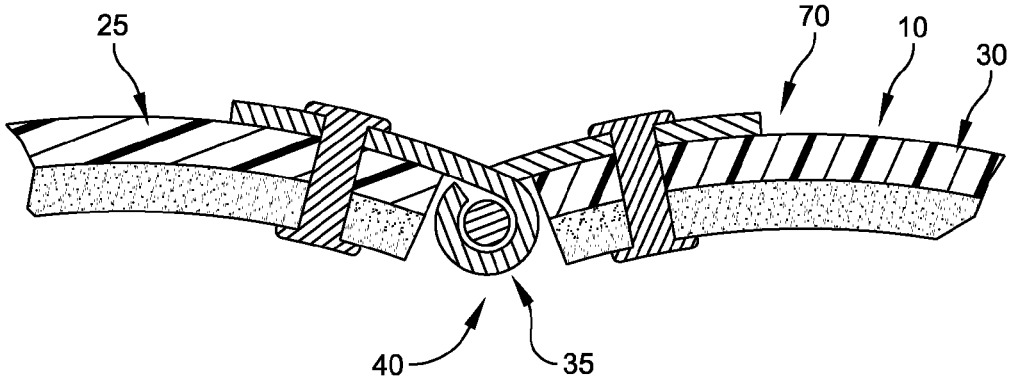
FIGS. 5A and 6A illustrate a cross-sectional view of another embodiment of the hinge of FIG. 3.
Figure 6A:
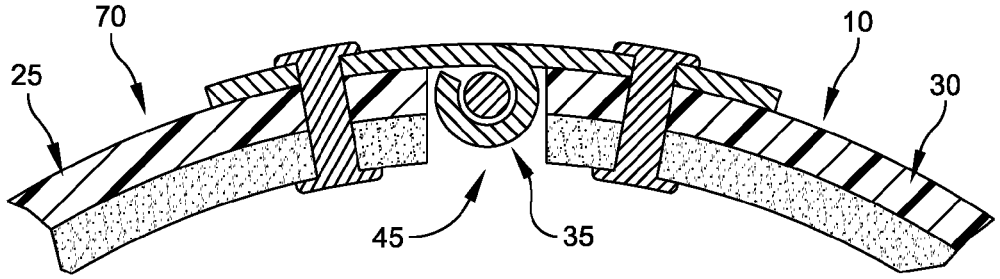
Figure 7:
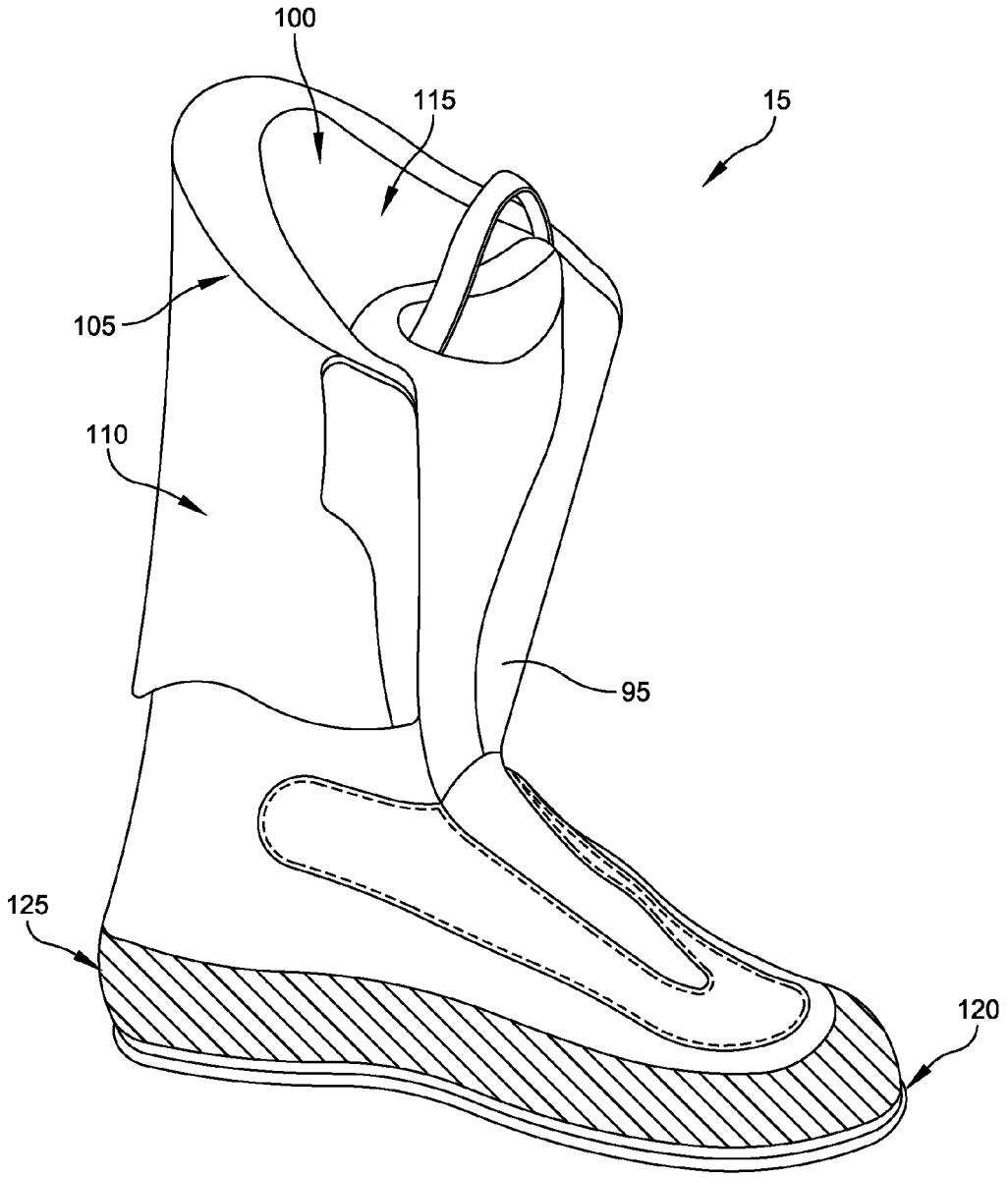
FIGS. 7-10 illustrate various view of the shape memory foam inner liner.
Figure 8:
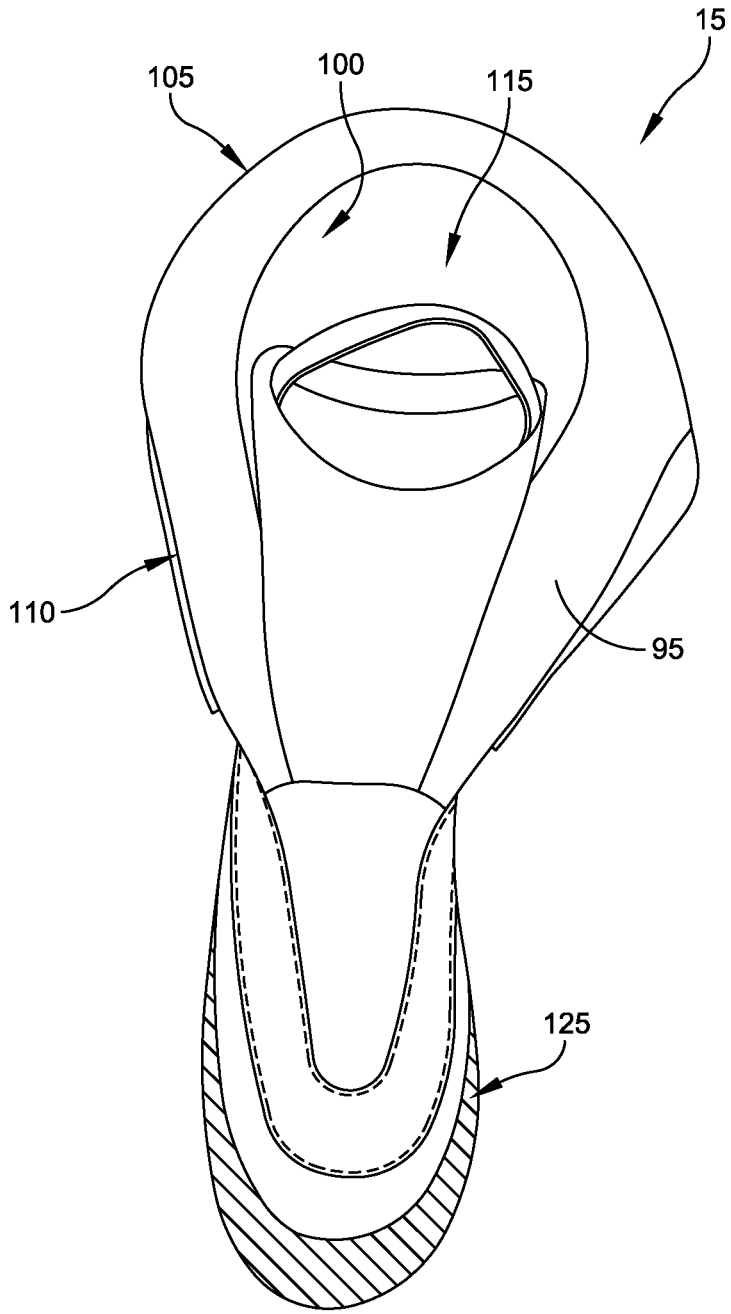
Figure 9:
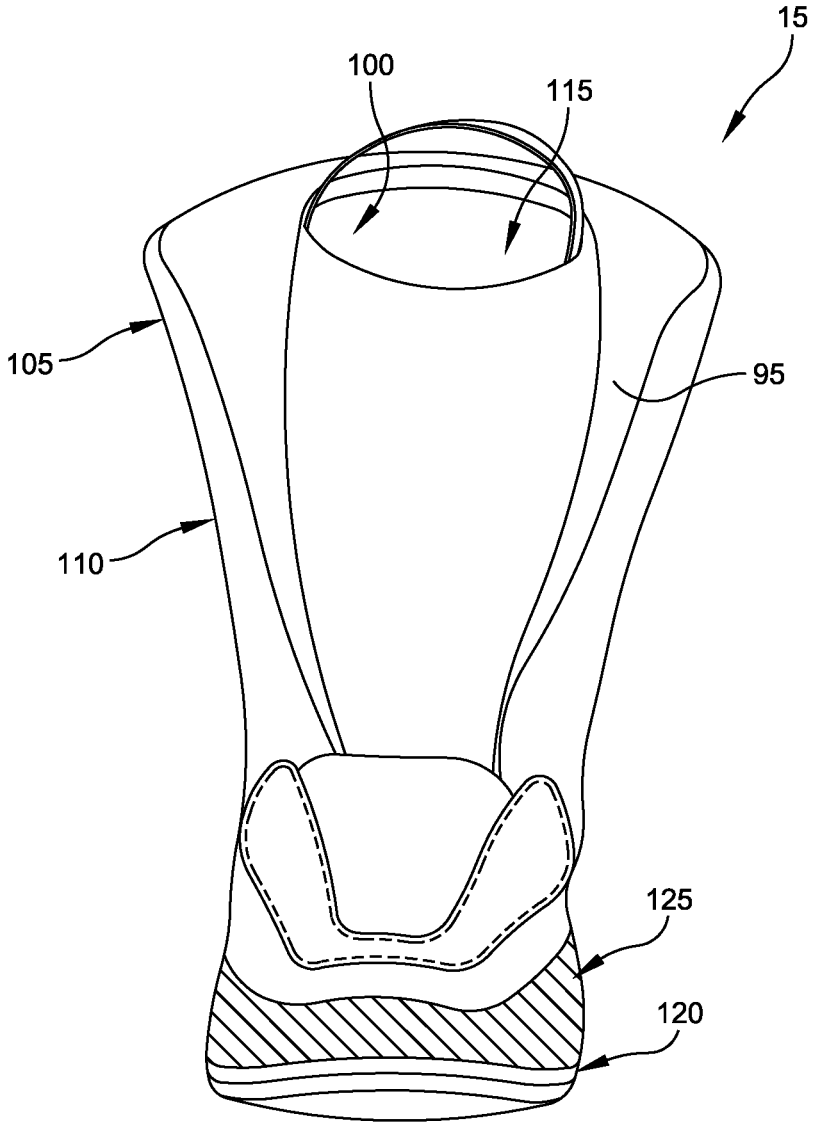
Figure 10:
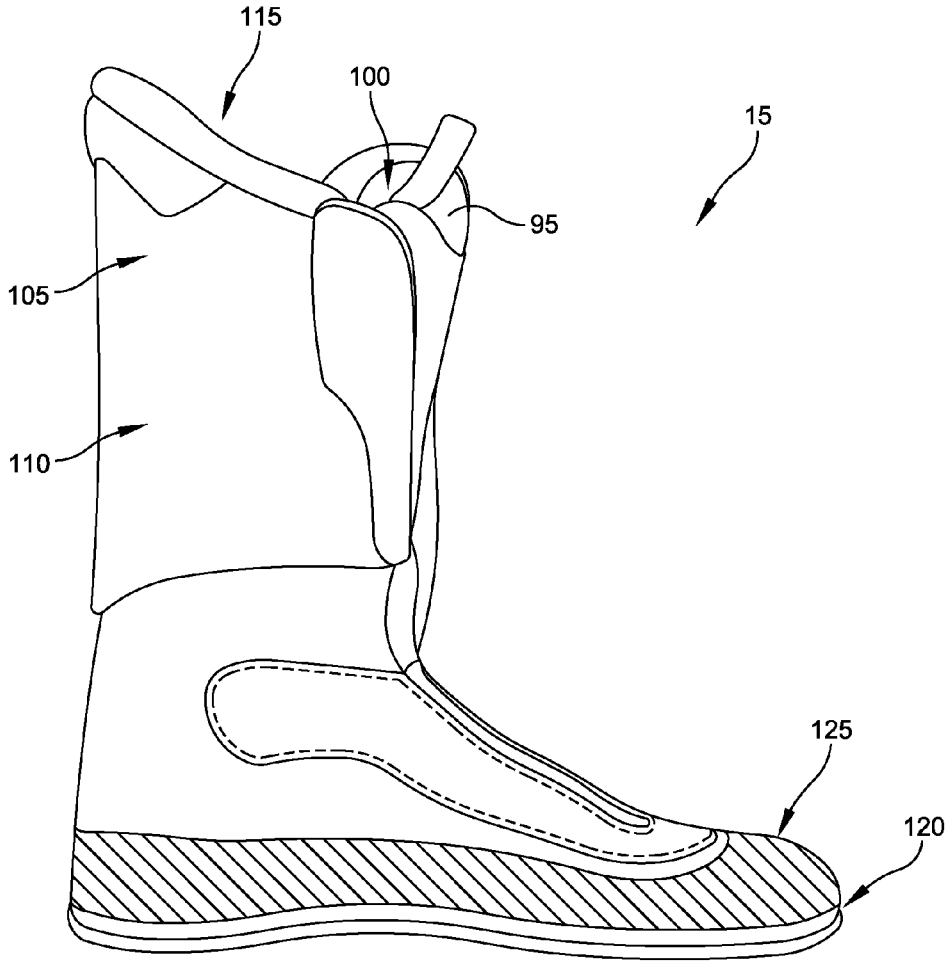

FIGS. 5A and 6A are cross-sectional illustrations of embodiments of the hinged connection 35 between the right side portion and the left side portion. In FIG. 5A, the hinged connection 35 is shown in the open configuration 40. In FIG. 6A, the hinged connection 35 is shown in the closed configuration 45. In one embodiment, hinged connection 35 may be disposed protruding toward the outer shell 10 at the heel 70.

The inner liner 15 provides both comfort and protection while increasing the skier's performance. The padding of the inner liner 15 cushions the foot and ankle, protects it from friction, impact and cold as well as creating full foot contact, which forms the foundation for energy to transfer from the body to the ski. Ski performance is directly related to how well the foot contacts the inner liner of the boot and how well the inner liner integrates with the outer shell.

With reference to FIG. 1, the selectively fastenable connector 55 may be disposed at a front (or toe) portion of the longitudinally split shell 10. In an embodiment, the selectively fastenable connector 55 is a buckle system 75 having a ladder 80, bail 85, and latch arm 90. A recessed portion 95 may be provided at the front (or toe) portion and the recessed portion 95 may be configured to receive the bail 85 of the selectively fastenable connector 55. This recessed portion 95 may include notched out sections of the shell 10 in order to hold the cable or bail 85 of the connector 55 just above the front lug of the shell 10. This lug is the portion that clicks into a ski binding. Blending the cable into the shell prevents any adverse effects on the operation of the boot and binding interface. However, there is usually a gap between the boot and the binding so as to allow the cable or bail 85 to remain slightly exposed from the surface of shell 10.

Current custom liners are rigid and hard for performance. With the liner 15 including shaped memory form, as long as the foot is securely wrapped, the heel is locked into place within the liner 15, there is high performance achieved with even the use of softer foam. Without the longitudinal split 20, it would be difficult to slide the foot into the liner 15 within the boot. Otherwise, a much thinner layer of memory foam would need be implemented and it would to provide the surrounding support to the user's foot. In various embodiments, the thickness of the memory foam around the ankle is about 1.5 to 2 inches. Around the rest of the heal wrap, it is about 1 to 1.5 inches.

In an embodiment, the outer surface 105 may include a sole 120 so as to allow use of the inner liner 15 as a snow boot apart from the outer shell 10. Extending upwardly from the sole 120, the outer surface 105 may include a rubber covering 125. This covering may extend upwardly from the sole about 1-2 inches, or more.

Figure 11:
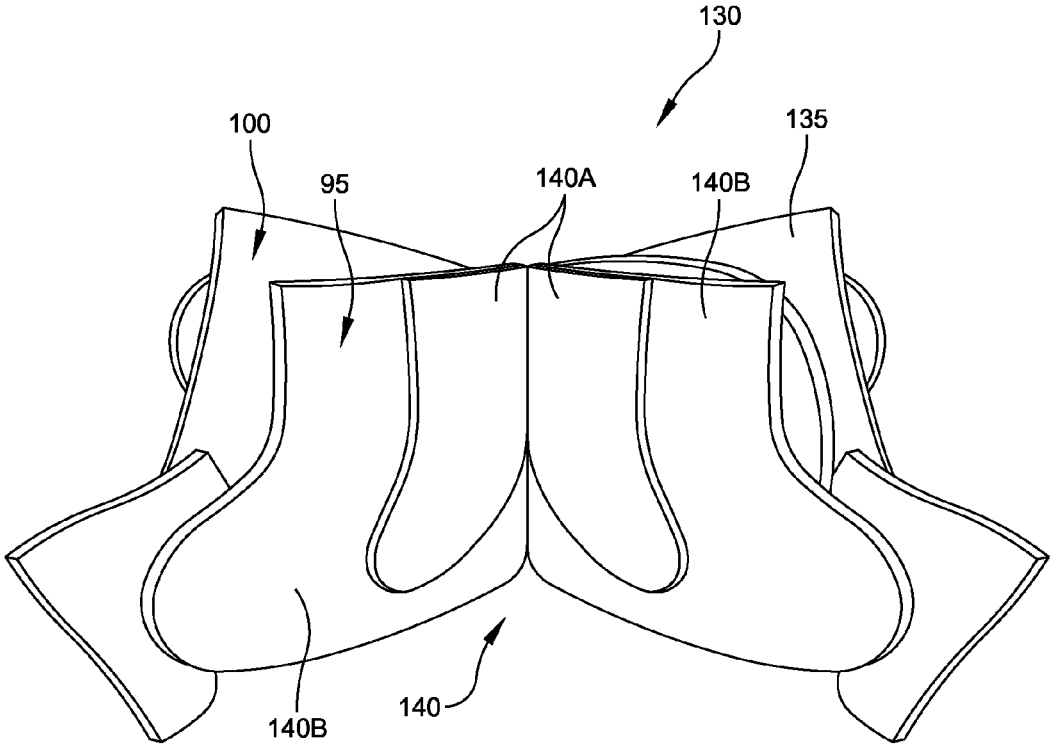
FIGS. 11-13 illustrate various views of a combination of foam materials in the heel portion of the line of FIGS. 7-10.
Figure 12:
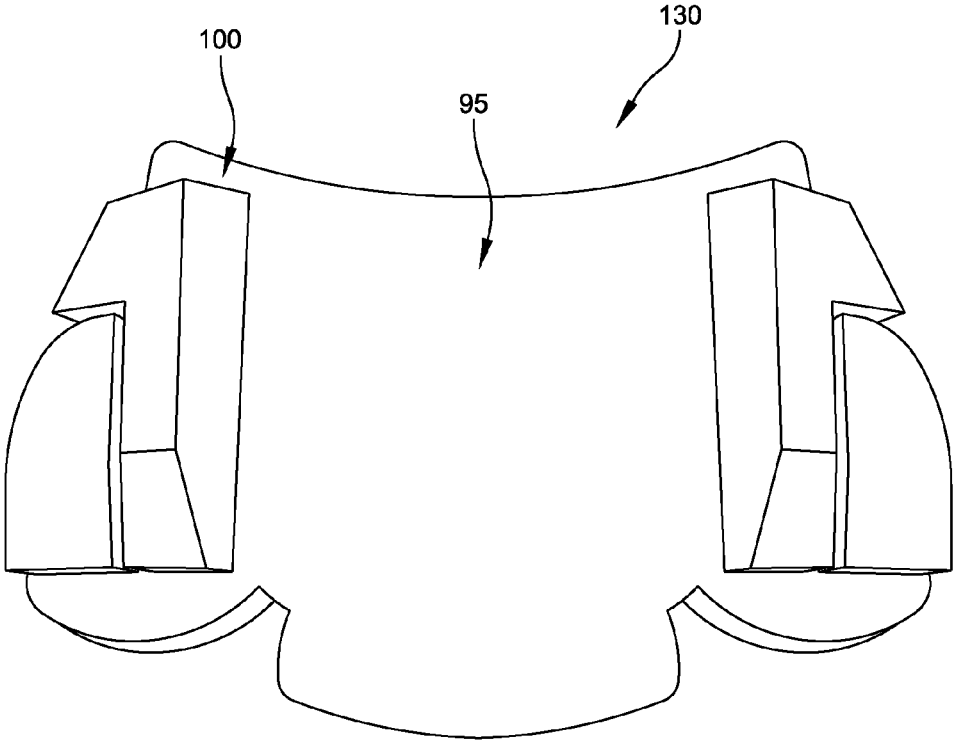
Figure 13:
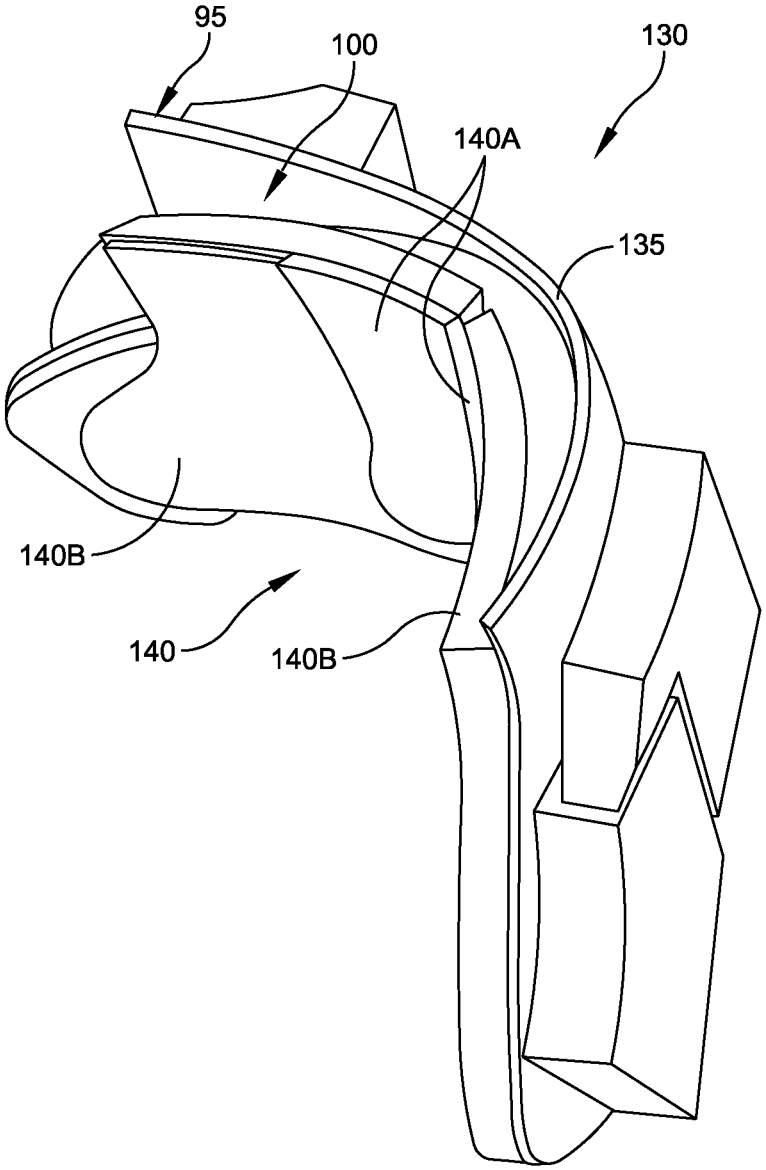

FIGS. 11-13 illustrate a heel reinforcement section 130 of the inner liner 15. The heel and ankle reinforcement section 130 may include a wrap portion 135 together with a support portion 140. The wrap portion 135 may include a carpet foam type material. The support portion 140 may include a shape memory material.

In one embodiment, the wrap portion 135 is a combination of a denser foam 140A and a memory foam 1408. The combination is of the denser foam 140A and memory foam 140B is used in the calf wrap and the tongue portion of the inner boot.

As illustrated, the inside of the heel wrap portion 135 has a denser foam piece the holds down the back of the heel area. The next layer is the memory foam 1358 and behind that is a denser foam butterfly wrap.

Figure 14:
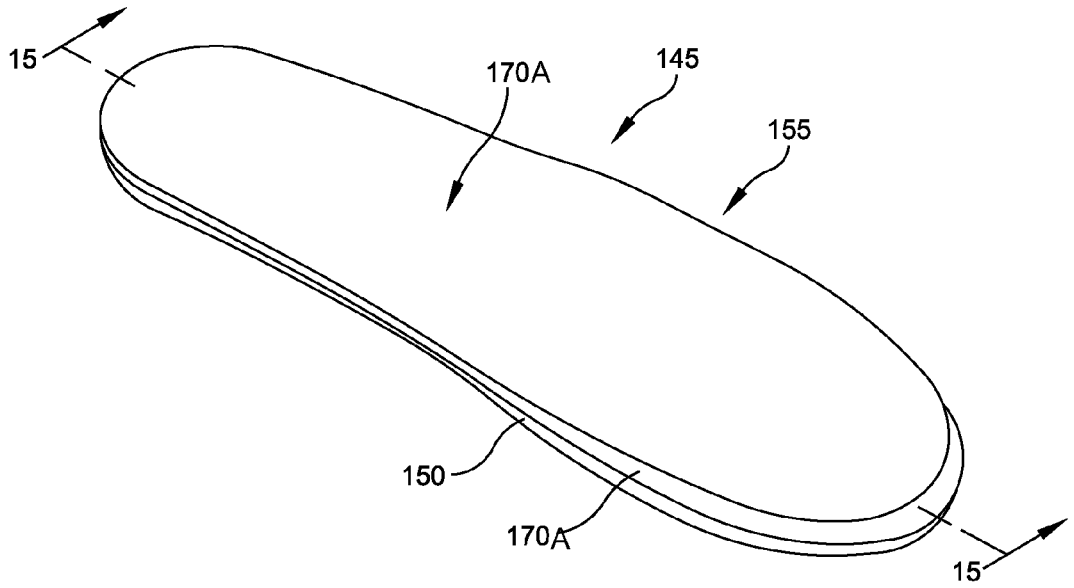
FIGS. 14 and 15 illustrate a foot bed for use in the inner liner.
Figure 15:
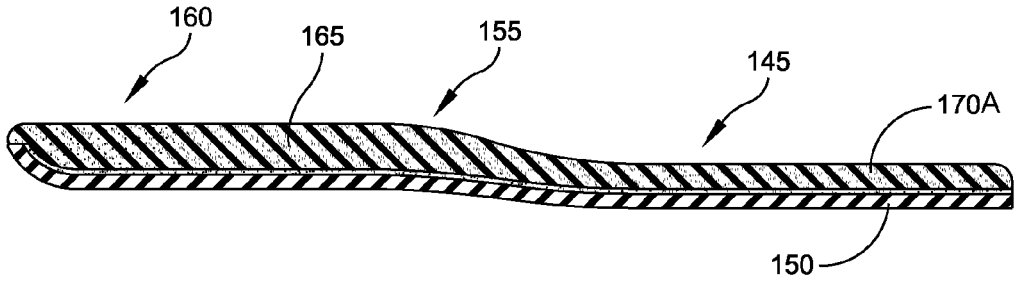

In an embodiment, and with reference to FIGS. 14 and 15, wherein a foot bed 145 may be provided for disposal within the interior 115 of the liner 15. The foot bed 145 of a ski boot provides the support for the sole of the foot. The foot bed may include a cork portion 150 configured to provide an arch support 155 and a heel cup 160. The greater the surface area of the foot making contact with the foot bed 145 the better the control and performance of the boot. For this reason, many skiers turn to custom moldable foot beds that match the contours of the foot perfectly. However, a custom moldable foot bed does not reconfigure to any changes in a particular individual's foot or to multiple individuals using a single boot. Using a memory foam portion 165 disposed on the cork portion 150, a remolded foot bed is provided with each use of the boot as the memory foam portion 165 molds to the foot at each use. A thin fabric portion 170A disposed on the memory foam portion 165 provides reduced friction when sliding the foot into the inner liner 15 and onto the foot bed 145.

Figure 16:
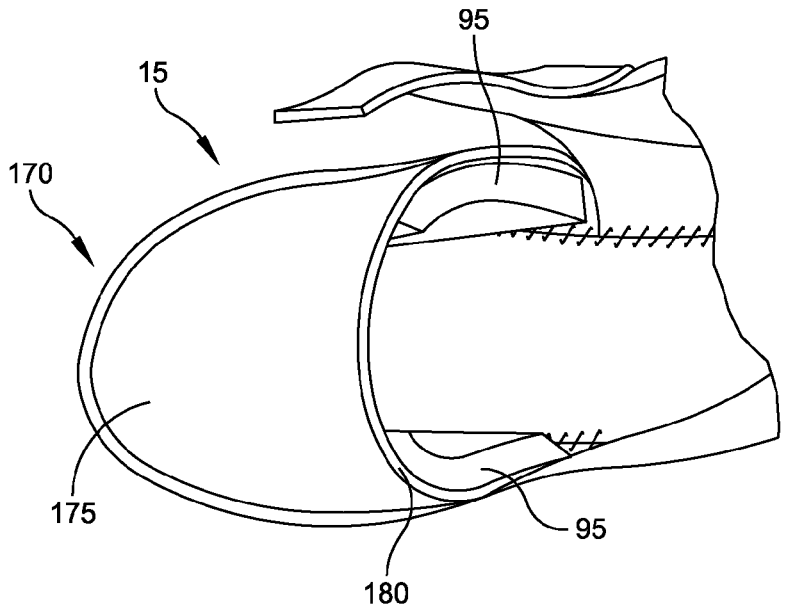
FIGS. 16 and 17 illustrate the toe section of the line of FIGS. 7-10.
Figure 17:
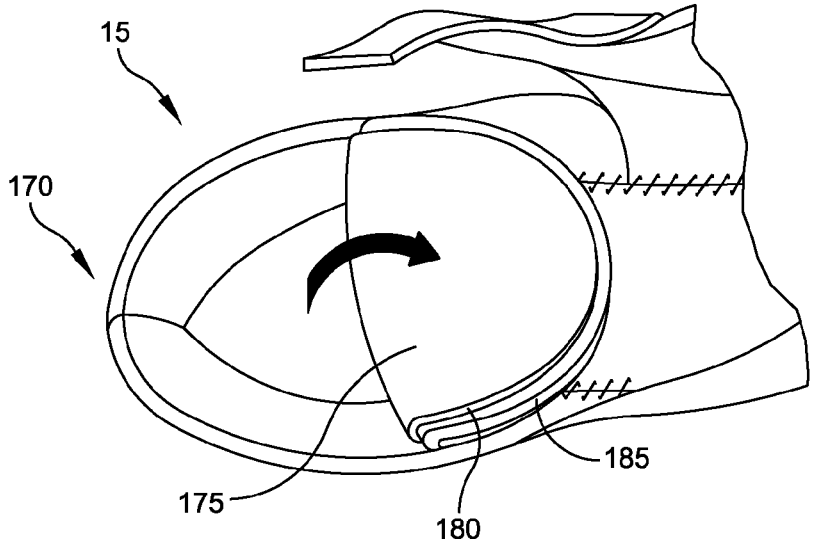
Figure 18:
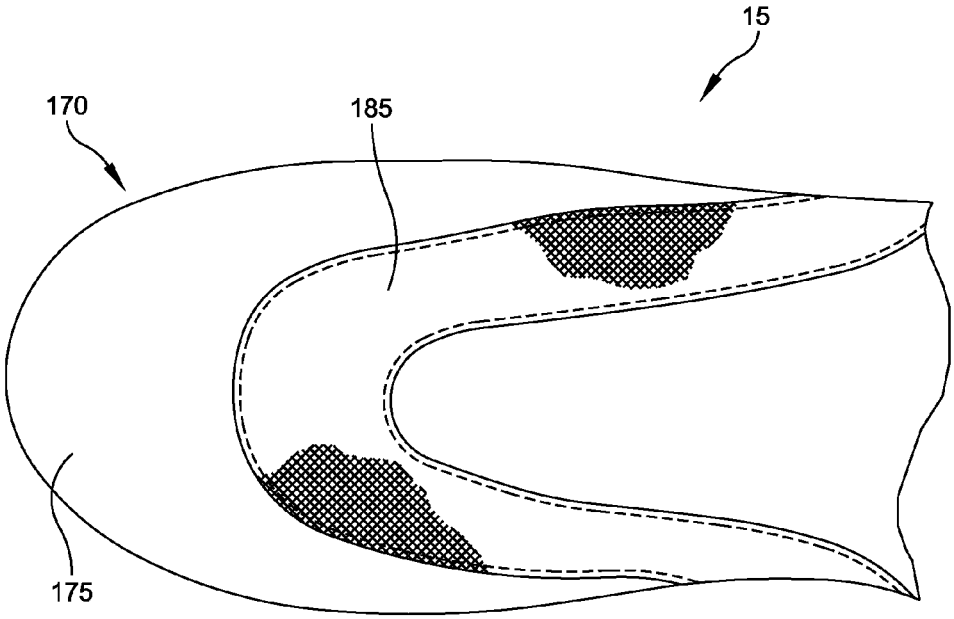
FIG. 18 illustrates the outer surface of the toe and instep.

FIGS. 16-18 illustrates the toe area 170 of liner 15. An expandable piece 175 may be disposed on the outside of the toe area 170. Memory foam wall material 95 lines the toe area 170 and a thin linen piece 180 covers and holds in place memory foam material 95. A reinforcement portion 185 may be disposed on the inner liner 15 in combination with Spandex stretch fabric material, or other suitable stretch fabric material, In an embodiment, and with reference to FIG. 19, the inner liner 15 contains the skier's foot and is disposed within outer shell 10 in the open configuration 40 prior to either removal of the inner liner 15 worn by the skier from the outer shell 10 or closure of the outer shell 10 for closing the ski boot to ski.

In various embodiments, ski boot system 5 may include both outer shell 10 and inner liner 15, or ski boot system may include only outer shell 10 or inner liner 15 apart from the other component.

In another embodiment, the hinged portion and the selectively fastenable connector may be repositioned with respect to one another so as to selectively open and close the ski boot with respect to the longitudinally split opening. The longitudinally split sections of the boot, together with the selectively fastenable connector, or other skier operable closures, allow for ease of entry, enhanced comfort, and optimized boot fit.

In other embodiments, the hinged connection may be placed on the bottom or sole together with buckles on the front and back of the shell. The two longitudinally split halves of the shell may be connected by magnets, buckles, or other combinations of selectively operable fasteners.

In an embodiment, a rubber gasket may be provided on the front portion of the longitudinal split 20, or various portions of the longitudinal split, in order to prevent snow, water, and other material from entering into the interior 50 of shell 10. Overlapping or interlocking portions of the right side portion 25 and the left side portion 35 may be provided on the bottom of the shell 10 in order to prevent leaking into the liner. In addition, this overlapping configuration may provide rigidity in order to prevent unwanted flex of the outer shell 10 during skiing.

Figure 19:
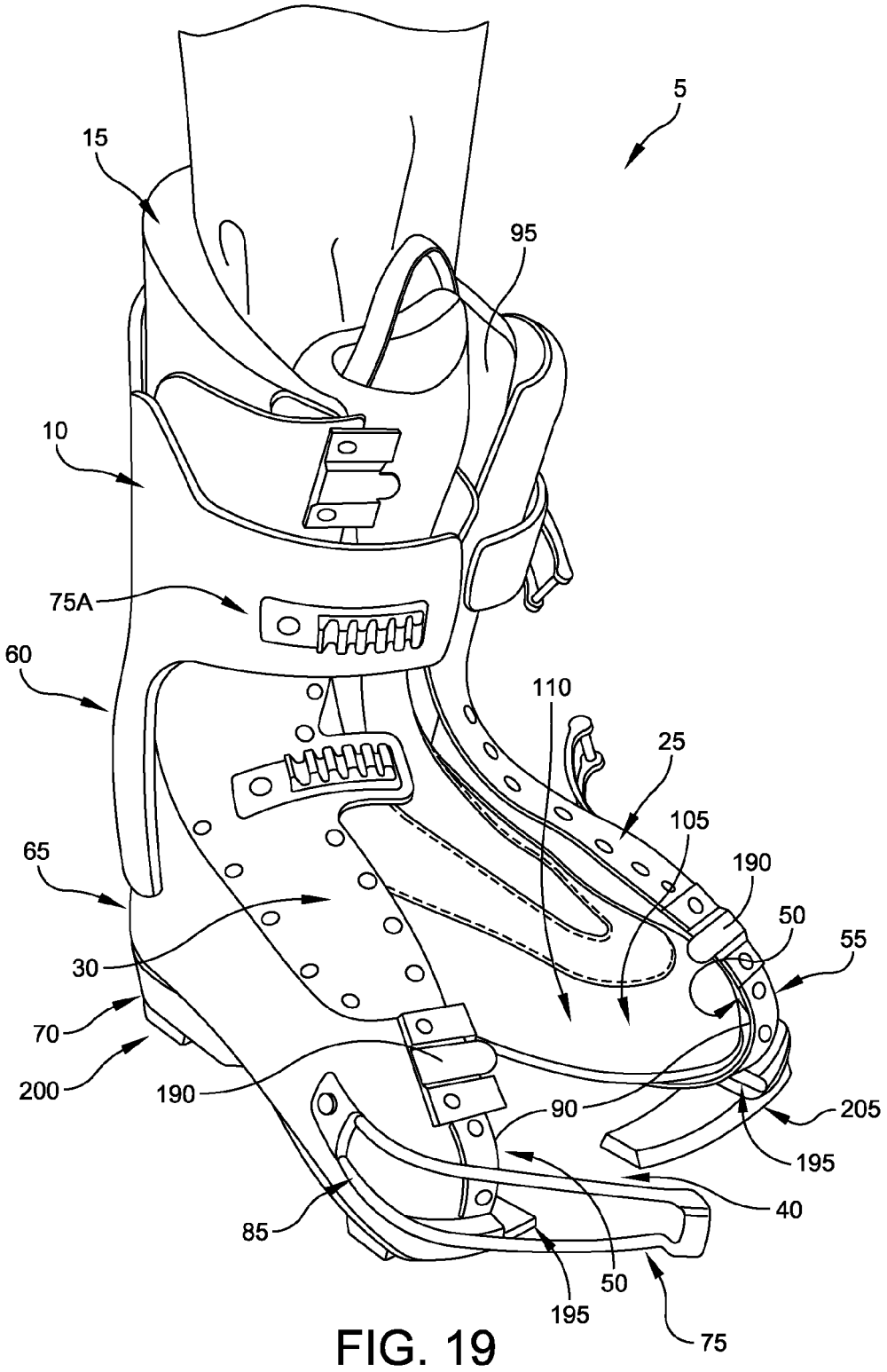
FIG. 19 illustrates the liner worn by a skier in which the outer shell is opened to allow insertion or removal of the line while disposed on the foot of the skier.

Referring to FIGS. 1 and 19, and in an embodiment, interlocking reinforcements 190 may be provided adjacent to longitudinal split 20. As illustrated, these interlocking reinforcements 190 are discrete components added to the shell 10. This prevents the two longitudinal halves of the shell from overlapping with one another. This also prevents the portions of the shell 10 from sliding across each other as the skier makes a turning motion or other rotational twist of the foot. These reinforcements may be made of metal or other suitable material. In other embodiments, these reinforcements may be integral or otherwise formed into the right side portion 25 and the left side portion 30.

In an embodiment, with reference to FIG. 19, there may be provided a riveted hinge attachment 190 pivotally attaching one or more of the buckle systems 75 to the outer shell 10. The riveted hinge attachment 190 allows movement of the buckle system 75 away from the longitudinal split to allow for easier insertion and removal of the skier's foot inside of the inner liner 15. In FIG. 19, there is shown an interlocking boot board 195, which provides added rigidity and reinforcement as described hereinabove.

In an embodiment, with reference to FIGS. 3 and 4, there may be provided a replaceable heel component 200 and a replaceable toe component 205. The replaceable heel component 200 and the replaceable toe component 205 may be replaceably attached to one of the right side portion 25 and the left side portion 35 and simply slide into the position with respect to the other portion. In other embodiments, these components may attach in various manners to one or both of the right side portion 25 and the left side portion 35.

Although the above embodiments have been described in language that is specific to certain structures, elements, compositions, and methodological steps, it is to be understood that the technology defined in the appended claims is not necessarily limited to the specific structures, elements, compositions and/or steps described. Rather, the specific aspects and steps are described as forms of implementing the claimed technology. Since many embodiments of the technology can be practiced without departing from the spirit and scope of the invention, the invention resides in the claims hereinafter appended.

What is claimed is:

1. A ski boot system, the ski boot system comprising:

an outer shell and an inner liner of the ski boot, the outer shell comprising:

an upper cuff and a lower cuff separable from one another and disposed in a vertical configuration adjacent to one another;

a right side portion and a left side portion formed by a longitudinal split through each of the upper cuff and the lower cuff of the outer shell of the ski boot;

a hinged connection between the right side portion and the left side portion of each of the upper cuff and the lower cuff, the hinged connection disposed at a rear portion of each of the upper cuff and the lower cuff, the hinged connection permitting selective positioning of the outer shell between an open configuration and a closed configuration, the open configuration allowing placement of the inner liner into the interior of the shell, and the closed configuration restricting removal of the liner from the interior of the shell; and a selectively fastenable connector extending between the right side portion and the left side portion of each of the upper cuff and the lower cuff, the selectively fastenable connector permitting selective positioning of the outer shell between the open configuration and the closed configuration with only a hand of a user and without an additional tool; and the inner liner comprising:

a wall of material defining an inner surface and an outer surface, the outer surface defining an exterior having dimensions sized to compressively fit within the outer shell of the ski boot, and the inner surface defining an interior having a given set of dimensions forming a liner interior volume, and the liner interior volume of the interior of the inner liner defining a smaller volume than the volume of the foot of the skier prior to at least one of compressive forces from closure of the outer shell and compressive forces from insertion of the foot of a skier; and a shape memory foam forming at least a portion of the wall of material, the shape memory foam configured to conform to the shape of the foot of the skier; and wherein the hinged connection is disposed at a rear portion of the longitudinally split shell, wherein the hinged connection maintains the right side portion and the left side portion in pivotal attachment with one another, and wherein the selectively fastenable connector is a buckle system having a ladder, bail, and latch arm, and is disposed at a front portion of the longitudinally split shell.

2. The ski boot system of claim 1, wherein the outer surface includes a sole so as to allow use of the inner liner as a snow boot apart from the outer shell of the ski boot, and a rubber covering extending upwardly from the sole.

3. The ski boot system of claim 1, wherein the interior includes a foot bed disposed within the liner, and wherein the foot bed includes a cork portion configured to provide an arch support and a heel cup, a memory foam portion disposed on the cork, the memory foam portion molding to the foot at each use, and a thin fabric disposed on the memory foam to provide reduced friction when sliding the foot into the interior liner and onto the foot bed.

* * * * *